United States Patent [19]

Chamblee et al.

[11] Patent Number: 4,807,885

[45] Date of Patent: Feb. 28, 1989

[54] CARD GAME

[76] Inventors: William A. Chamblee, 1360-B Harbour Dr., Wilmington, N.C. 28401; Raymond Williamson, 7008 Jeffery Dr., Raleigh, N.C. 27603

[21] Appl. No.: 68,154

[22] Filed: Jun. 30, 1987

[51] Int. Cl.[4] ..... A63F 1/00

[52] U.S. Cl. ..... 273/292; 273/306

[58] Field of Search ..... 273/148 R, 292, 303, 273/306

[56] References Cited

U.S. PATENT DOCUMENTS

| | | | |
|---|---|---|---|
| 4,196,905 | 4/1980 | Yanari | 273/148 R |

FOREIGN PATENT DOCUMENTS

| | | | |
|---|---|---|---|
| 2405724 | 6/1979 | France | 273/292 |
| 2465501 | 4/1981 | France | 273/302 |
| 0811083 | 4/1959 | United Kingdom | 273/292 |
| 1542228 | 3/1979 | United Kingdom | 273/292 |
| 2026871 | 2/1980 | United Kingdom | 273/292 |

OTHER PUBLICATIONS

Miller et al., "*Zero*": *An Addition Game with Integers,* 1/77, Mathematics Teacher.

Leeming, *Games with Playing Cards,* 11/50, pp. 83–85, Knickerbocker Printing Corp.

*Primary Examiner*—Carlton R. Croyle
*Assistant Examiner*—Eugene L. Szczerina, Jr.
*Attorney, Agent, or Firm*—Rhodes, Coats & Bennett

[57] ABSTRACT

The present invention entails a card game comprising a deck of cards having a series of cards with numerical values and a plurality of special or wild cards. A selected value, for example, "ninety-nine" is chosen and forms a main or central part of the game. In playing the game, players in turn discard one card at a time. As the cards are discarded the cumulative value of the respective cards are continually added by the players. Once the cumulative value of the discarded cards approach the chosen value, "ninety-nine" in the example being discussed, no player may discard a numerical value card that would cause the cumulative value to exceed "ninety-nine". However, the special or wild cards may be played at any time. The object of the game is to always have a "play". When a player does not have a "play" he or she is required to leave the game. The last remaining player is declared the winner.

5 Claims, 3 Drawing Sheets

CARD GAME

FIELD OF THE INVENTION

The present invention relates to games and particularly card games.

BACKGROUND OF THE INVENTION

Card games have for a long time provided entertainment and amusemement for adults and children alike. Because card games are interesting, exciting, and even challenging, they are often able to hold and maintain the attention of players for hours at a time. Beyond simply the pure enjoyment of card games, card games provide an opportunity for people to join together in fun and fellowship.

Although many well-known card games are played by great numbers of people today, one finds that many of the card games commercially available today are designed around like and similar concepts. Put simply, many commercially available card games are very much alike and do not provide for stimulating and entertaining gaming.

There is an continues to be a need for more exciting, challenging and entertaining card games.

SUMMARY AND OBJECTS OF THE INVENTION

The present invention entails a card game that is exciting, suspenseful, and which requires skill and strategy to be successful.

In particular, the present card game is designed and structured around a threshold game value. In the present card game, the selected threshold game value is "ninety-nine". The card game includes a deck of ninety-nine cards with a series of numerical value cards along with a series of special or wild cards. The game is designed to be played such that the respective players discard one card at a time as the play moves around the group of players. The cumulative value of the discarded cards is added by the players. Once the total cummulative value of these cards approach "ninety-nine" no player can discard a numerical value card that will exceed "ninety-nine".

The special or wild cards provide a means of making a play in certain situations where a player's numerical cards he or she may be holding would cause the cummulative value of the discarded cards to exceed the selected game value of "ninety-nine". These special or wild cards include a series of "pass" cards, "reverse" cards, "−20" cards, "−10" cards, "no play joker" cards, "wild" cards, and "automatic ninety-nine" cards.

The object of the game is to force each opponent into a situation where he or she has no play. That is when a player does not have a card in his or her hand that will keep the value of the discarded cards to "ninety-nine" or below, then that player departs from the game.

It is therefore an object of the present invention to provide an exciting, stimulating and challenging card game.

Another object of the present invention resides in the provision of a card game and method of playing where success depends on a very unique blend of skill, strategy and luck.

Another object of the present invention resides in the provision of a card game and method of playing that is designed and structured around discarding one card at a time from one's hand wherein the cards discarded are cummulatively added and wherein discarding is controlled by a threshold game value that cannot be exceeded.

Another object of the present invention resides in the provision of a card game and method of playing that is relatively simple to understand and which can be played and enjoyed by people of all ages.

Other objects and advantages of the present invention will become apparent and obvious from a study of the following description and the accompanying drawings which are merely illustrative of such invention.

DETAILED DESCRIPTION OF THE INVENTION

With further reference to the drawings, the present card game is illustrated therein and in particular the respective cards comprising the card deck of the present game is shown. In the present disclosure the game is referred to as "Ninety-Nine". This is because the threshold or selected game value chosen for the game is "ninety-nine". It will be understood and appreciated from this disclosure that other threshold values could be selected for the game of the present invention.

Figure 2:
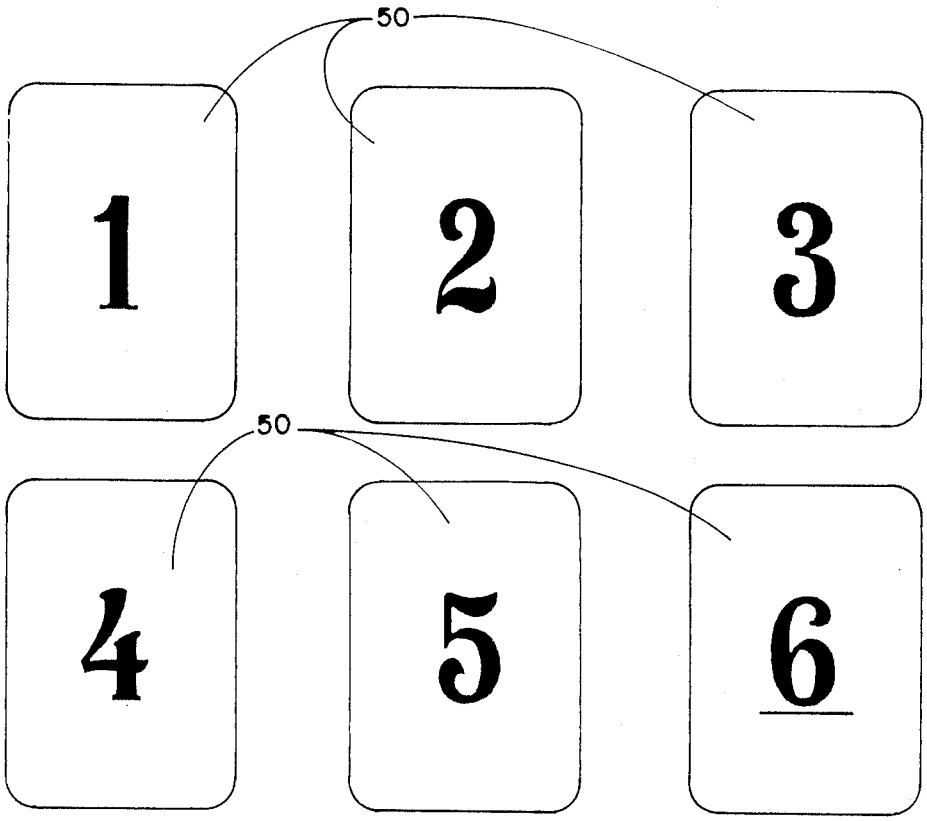
FIG. 2 shows a series of cards, cards 1 through 6, which form a part of the card deck of the present invention.

Viewing the card deck and the respective cards therein, note in FIG. 2 that cards 1 through 6 are shown. In FIG. 2, numerical cards 7 through 10 are shown. Respective numerical cards 1 through 10 are indicated in the drawings by reference numeral 50.

The deck of the present card game as structured includes six of each numerical card having a value of 1 to 10.

Figure 3:
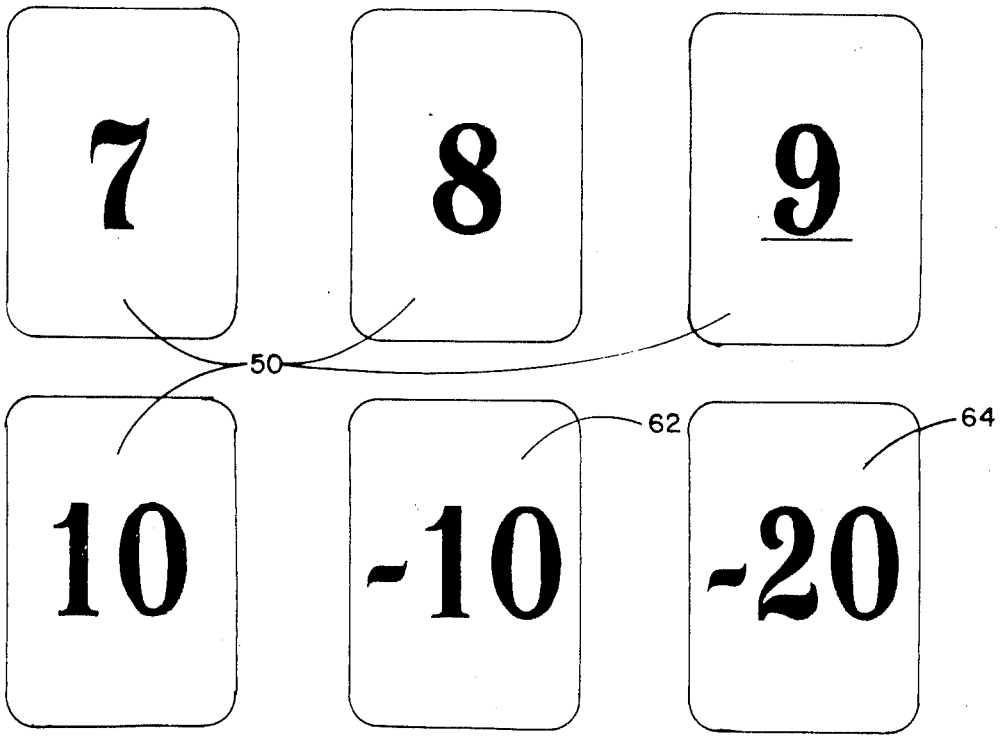
FIG. 3 illustrates numerical value cards 7 through 10 and special cards "−10" and "−20".

Aside from the numerical cards, the card deck of the present invention includes a series of special or wild cards that are sometimes referred to as "trick" cards. These special cards include four cards with a "−10" value, referred to by numeral 62 in FIG. 3, and four cards with a "−20" value, referred to by numeral 64.

Figure 4:
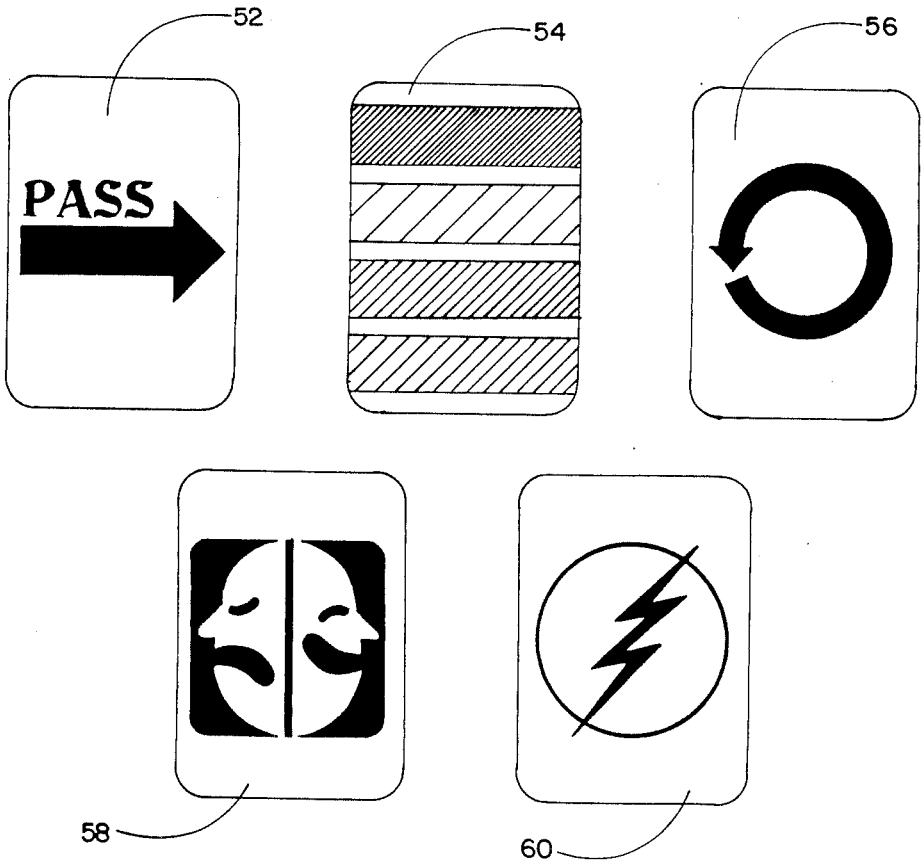
FIG. 4 illustrates five special cards found in the card game of the present invention.

Continuing to refer to the special or trick cards, in FIG. 4, there are five additional special or trick cards. These include eight "pass" cards 52 and four "wild" cards 54. In addition, there are eight "reverse cards 56 along with two "no play joker" cards 58. Finally, the special or trick cards include nine automatic "ninety-nine" cards indicated by the reference numeral 60.

Considering all of the above cards, the deck includes a total of 99 cards.

Figure 1:
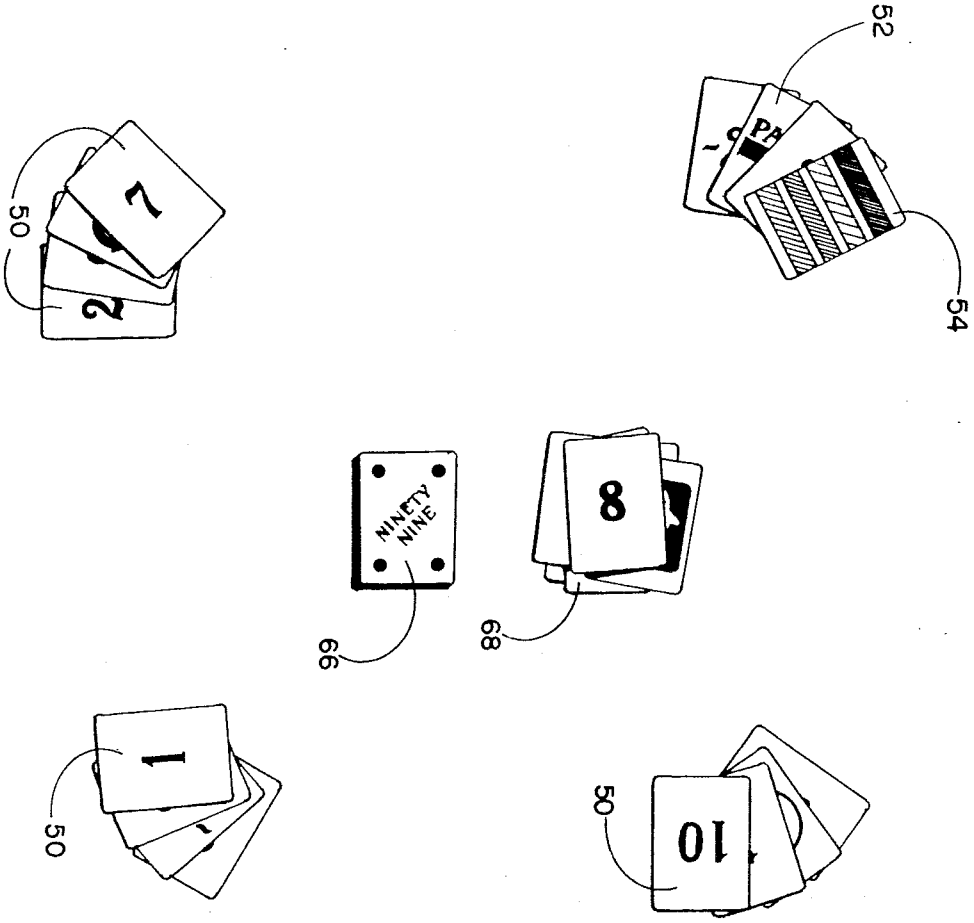
FIG. 1 is a top view illustrating the card game of the present invention being played and illustrates four hands, the drawing pile or deck, and the discard pile.

In playing the present card game "ninety-nine", any number of two or more players can play. Each player is dealt a hand of four cards and the remaining cards are turned facedown to form a draw pile indicated by the numeral 66 in FIG. 1. In FIG. 1 there is illustrated a four player game as there are four respective hands shown, again each hand including four cards. To start the game, the top card from the draw pile 66 is turned over. The player to the dealer's left begins play by discarding a selected card from his hand onto the initial card turned over from the draw pile 66. The player discarding then draws a replacement card from the top of draw pile 66 so that he or she always maintains a hand of four cards. A player always draws a card after discarding a card.

The players either individually or as a group add the numerical values of the initial card turned over from the draw pile 66 and the first card discarded by the first player. Thereafter play continues by the next player, that player to the left of the last player, discarding a card onto what is referred to as the discard pile 68. The value of that discarded card is added to the previous value of the cards lying in the discard pile 68 to give what is referred to as a "count". The same player discarding a card now draws a new card from the draw pile 66.

Play is continued in clockwise fashion with each card discarded onto discard pile 68 being added to the previous count.

In the present disclosure, the game threshold or preselected value in which the entire game is structured around is "ninety-nine". Therefore as a basic and fundamental rule of the game, the count can never exceed "ninety-nine".

For example, assume the count has reached "ninety-six" and play advances to a player that holds a six, seven, eight, and a nine. This particular player cannot make a discard or play because either of these four cards would cause the count to exceed "ninety-nine". This means that that player has to leave the game since he or she does not have a play. After that, the game continues in the same fashion and sequence described above.

As the count approaches the threshold count, then the benefit of the special or trick cards becomes apparent. Viewing the special cards as shown in the drawings, note pass card 52. Pass card 52 in the possession of any player enables that player to discard the same and pass the play to the next player in turn. Therefore, if a player holding a pass card 52 is faced with a situation where he or she does not have a play because any numerical value card would push the count above "ninety-nine" then that player can discard the pass card 52 and play is transferred to the next player in turn.

Next, attention is directed to reverse card 56. Reverse card 56 enables a player holding the same to reverse play and shift the next play to his or her right. Thus, by playing reverse card 56 this reverses the direction of play.

The reverse card 56 is a powerful card, even more powerful than pass card 52. For example, if the preceding player has moved the count to "ninety-nine" then with the play of a reverse card 56 that count is placed back on that same player.

Next, references made to the "−10" and "−20" cards referred to by numerals 62 and 64 respectfully. These cards are effective in altering the count. For example, a player holding either one of these cards can at any time reduce the count, a "−10" or "−20".

As pointed out above, there are two "no play joker" cards 56. If a player draws one of these cards he or she is stuck with that card throughout the game as that card cannot be played. This effectively reduces the playable cards in one's hand and therefore decreases the number of cards to choose from on each and every play after acquiring the "no play joker".

Another special or trick card is the "automatic ninety-nine" card referred to by numeral 60. This is also a very powerful card that when played automatically moves the count to the threshold value of "ninety-nine". It is very powerful because if the next player in turn does not have a special or trick card then this means the end of the game for that particular player.

Finally, there is the wild cards 54 which are the most powerful and flexible cards of the deck. A player may wish to make the count "ninety-nine" if he or she has what is deemed a good hand. If the player has what is deemed a poor hand he or she may make the count a "−150", for example. By making the count a relatively large minus number a player with a poor hand has the opportunity through time to discard high numerical value cards in the hope that his or her draws will replenish the hand with special and low valued cards.

With respect to special rules, if the top card of the draw pile 66 is a "ninety-nine", "wild", or "no play joker", then the game starts with a count of ninety-nine for the first player to the dealer's left.

If the top card of the draw pile 66 is a "pass" card then the player to the dealer's left does not play. He passes his play to the player to his left with the count starting on zero.

If the top card of the draw pile 66 is a "reverse" then the player to the dealer's right begins with a count on zero and the game proceeds in a counterclockwise playing order.

From the forgoing discussion with respect to the present card game and the various game rules and procedures, it is seen that once the count reaches "ninety-nine" in order for a player to proceed and remain in the game, he or she must have a special or trick card available for discard.

If the count reaches "ninety-nine" and there is a play called for by a player and that player does not have a special or trick card then he or she is automatically eliminated from the game. Thereafter, as pointed out above, the game continues to proceed. Special or trick cards of the type referred to by numerals 52 through 64 can be played at any time in the game depending upon the strategy being employed by a particular player. For example, a player may feel somewhat lucky and that he has a superior hand at the beginning and decide at an outset of a game to play a special card and put the count on "ninety-nine". This may have the effect of forcing some or even all of the players out of the game early. Obviously, this strategy has risks as other players may have an ample supply of special or trick cards in their hands and the count of "ninety-nine" may be passed back to the instigator of this early strategy.

It is therefore appreciated that the low value cards, for example, a "1" or "2" is more valuable than a high value card such as a "9" or "10". This is because as a count is approaching "ninety-nine", then a player can play a low value card without exceeding the threshold value, thereby avoiding the requirement of having to play a special card if in fact the player has a special card in his or her hand.

It is further appreciated that a "9" or "10" may also prove to be valuable. For example, consider the count being "99" and the next player playing a "−10", making the count "89". A player holding a "10" can then play the same bringing the count back to "99" and forcing the next player to play a special or trick card.

From the foregoing, it is appreciated that the last player remaining in the game is declared the winner. It is also appreciated that with the special or trick cards distributed throughout the deck that this makes for an exciting and suspenseful card playing game. Because of the selected distribution of these special cards, the card game is designed for interest and excitement. In various game situations, one player may even have the feeling that other players are teaming against him or her. In fact that very well may be the case. The present game through this special mix of numerical cards and special or trick cards is designed to reward skill and strategy but at the same time incorporate an appropriate factor of luck that gives the entire game a tremendous amount of appeal for a wide range of players including small children, teenagers and adults. It is this appeal that makes the game quite a addictive.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of playing a card game wherein the card game includes a series of numerical value cards and special cards and wherein the card game includes a preselected threshold game value that cannot be exceeded during the course of the game, the method of playing the card game comprising the steps of: dealing a set of cards to a plurality of players and forming a draw pile of cards; starting a discard pile by transferring a first card from the draw pile and adding to the discard pile by respective players discarding one card at a time as their playing turn comes around and thereafter drawing a replacement card from the draw pile of cards; establishing a numerical count by adding assigned numerical values of all cards discarded into the discard pile; establishing a threshold game value that is to be never exceeded by the numerical value of the established count of the discard pile; continuing to maintain a count by adding the numerical values of the respective cards discarded by the players and placed on the discard pile; prohibiting a player from discarding any card onto the discard pile that would cause the ongoing and cummulative count of the respective cards thereon to exceed the selected threshold game value; discarding special cards of the game onto the discard pile that effectively permit a player to make an additional discard play even if the threshold game value has been reached; the step of discarding special cards including the step of discarding a wild card and placing a selected value on that card, even a minus numerical value, so long as the count after adding in the assigned value of the wild card does not exceed the threshold game value; and the step of discarding special cards further including the step of discarding a card that automatically makes the count the threshold game value irrespective of the prior count; continuing to play the present game in a turn fashion until one or more players faces a situation where he or she does not have a play that would not exceed the threshold game value; continuing to play the present game until there is only one remaining player in the game as the other players have been forced out due to the fact that they reached a point where they had no play, thereby making the last remaining player the game winner.

2. The card game method of claim 1 wherein the step of discarding special cards includes the step of discarding a reverse card that results in the direction of play among the players being reversed.

3. The card game and method of claim 2 wherein the step of discarding special cards includes the step of discarding a pass card which passes play onto the next player in turn thereby permitting the player playing such card to continue in the game without actually having to make a play.

4. The card game method of claim 3 wherein the step of discarding special cards includes the step of discarding one or more cards having a selected negative value so as to reduce the count presented a respected player by the negative value of that card.

5. The method of claim 4 including restricting the number of playable cards a player may play at any one time by disbursing a plurality of "no play joker" cards throughout the deck whereupon the drawing of a no play joker card results in the player not being able to play that card, thus effectively limiting the playable cards in the players hand.

* * * * *